US005802610A

United States Patent [19]

Burr

[11] Patent Number: 5,802,610

[45] Date of Patent: Sep. 8, 1998

[54] MULTI-LAYER DISPOSABLE BIB

[76] Inventor: Susan Grey Burr, P.O. Box 4026, River Edge, N.J. 07661

[21] Appl. No.: 760,108

[22] Filed: Dec. 3, 1996

[51] Int. Cl.[6] ..... A41D 27/00; A41B 13/10

[52] U.S. Cl. ..... 2/49.4; 2/46; 2/49.1; 156/73.1

[58] Field of Search ..... 2/46, 48, 49.1, 2/49.2, 49.3, 49.4, 49.5, 50, 51, 52, 69, 69.5, 75, 80, 83, 114, 174, 113, 115; 604/385.1, 385.2; 428/577.5, 192, 195, 198; 156/73.1; 264/443, 444

[56] References Cited

U.S. PATENT DOCUMENTS

| | | | |
|---|---|---|---|
| 889,073 | 5/1908 | Walbridge . | |
| 2,440,666 | 4/1948 | Miller | 2/49 |
| 3,329,969 | 7/1967 | Farber et al. | 2/49.4 |
| 3,416,157 | 12/1968 | Marder et al. | 2/48 |
| 3,619,816 | 11/1971 | Cowen | 2/48 |
| 3,916,447 | 11/1975 | Thompson | 2/46 |
| 3,979,776 | 9/1976 | Gruenwald | 2/49 |
| 4,078,124 | 3/1978 | Prentice | 429/144 |
| 4,411,660 | 10/1983 | Dawn et al. | 604/396 |
| 4,475,250 | 10/1984 | Savin et al. | 2/49 |
| 4,620,323 | 11/1986 | Tepper | 2/49 |
| 4,660,225 | 4/1987 | Kahn | 2/49 |
| 4,733,411 | 3/1988 | Foti | 2/49 |
| 4,779,288 | 10/1988 | Mack | 2/49 |
| 4,884,299 | 12/1989 | Rose | 2/49 |
| 5,306,267 | 4/1994 | Hahn et al. | 604/378 |
| 5,432,952 | 7/1995 | Tate | 2/49 |
| 5,490,289 | 2/1996 | Lehrer | 2/49 |
| 5,522,809 | 6/1996 | Larsonneur | 604/361 |

FOREIGN PATENT DOCUMENTS

| | | | |
|---|---|---|---|
| 2811624 | 2/1980 | Germany | 2/49.4 |

*Primary Examiner*—Jeanette E. Chapman
*Attorney, Agent, or Firm*—Friscia & Nussbaum

[57] ABSTRACT

A multi-layer disposable bib is provided. The layers of material of the bib are ultrasonically bonded together. The first layer is located at the exterior surface of the bib and is made of a lightweight, non-woven material which is tear resistant. The second and third layers are composed of highly absorbent tissue paper to absorb liquids. The fourth layer is a waterproof, polypropylene film that is impermeable to liquids and also provides additional strength to the bib. The fifth layer is located at the other exterior surface of the bib and is made of the same lightweight, non-woven material as the first layer. The two outer layers of non-woven material are soft to the touch and liquid permeable. The bib may be adjustably secured about one's neck by means of straps which extend from the bib and which include an adhesive tab for attaching the straps together.

19 Claims, 2 Drawing Sheets

MULTI-LAYER DISPOSABLE BIB

BACKGROUND OF THE INVENTION

1. Field of the Invention

This invention generally relates to a bib and more particularly to a disposable bib having multiple layers of material ultrasonically bonded together.

2. Related Art

A bib is a cover for temporarily protecting a person's body or clothing from liquids or stains during the consumption of food and drink. Bibs are also used to protect babies and their clothing from saliva from drool or spit. Bibs are often constructed from materials that are not aesthetically pleasing, nor particularly comfortable, nor even sometimes made with sufficient quality or workmanship.

The uncomfortable quality of a bib chiefly arises from the task that the cover is designed to perform. To better shield a person from liquid spills, it is necessary to make use of a liquid impermeable material such as plastic. Plastic may be successful at preventing liquids from soaking though the bib to contact the person's clothing, but bibs comprised entirely of liquid impermeable plastic may be uncomfortable to wear.

Also, to prevent liquids from reaching the body of a person, bibs are often made to cover an area from a one's neck to their stomach. As is often the case, the bib must be properly secured in a close fit about a person's neck. When the bib itself is made entirely a liquid impermeable plastic or vinyl product, it can become even more noticeably uncomfortable when secured so closely to the skin of the user.

In the past, there have been many attempts at fabricating bibs which employ various types of materials to achieve protection of a person as well as a comfortable fit. Often, these bibs have used combinations of materials such as plastic to provide liquid impermeability and cloth or a woven fabric to provide absorption. The underside of the bib, which contacts the person, however is typically plastic. In many of these products, the woven material about the exterior of the bib is physically attached to the plastic by glue or other chemical adhesive, or by stitching together the components about one or more seams.

Ultrasonic bonding provides a more efficient and environmentally friendly means of attaching various materials. Rather than relying on glues, adhesives or stitches, the separate layers of material are pressed together at various and bonded points over their surface area to be tightly meshed into a composite material having multiple layers. The points of contact between the materials are achieved by vibrations that are facilitated by the amplitude of sound waves directed at particular locations upon the surface area of the materials. While this manufacturing technique is known, it has not as yet been practiced in the art of fabricating multi-layer bibs.

Examples of previous efforts at a disposable bib include:

Larsonneur U.S. Pat. No. 5,522,809 (1996) discloses an absorbent and disposable pad for use in an adult diaper. The outer surfaces of the pad are comprised of a liquid impervious backing sheet and a liquid permeable upper sheet. The backing sheet and the upper sheet are secured to each other about their edges. Sandwiched between these sheets are separate tissue layers and paper fluff filler along with spatially separated barrier strips which absorb fluid. The surfaces of the interior tissues layers are oriented to facilitate the absorption of fluid by the barrier strips.

Lehrer, U.S. Pat. No. 5,490,289 (1996) discloses a baby bib having a pair of opposed leg segments that extend upwardly to serve as a closure about the neck of the wearer. A panel of absorbent material is removably affixed to the surface of the bib. A pocket is located at the lower end of the bib to collect items which fall upon the bib and are not retained by the absorbent material.

Tate U.S. Pat. No. 5,432,952 (1995) discloses a bib comprised of two layers of laminate material. The outer layer is a liquid absorbent layer, such as cloth, and the inner layer is a liquid impermeable, such as plastic. The bib has a neck contour for accommodatingly conforming to the shape of the wearer and further has a connection mechanism for placing the neck contour at the neck of the user to secure the bib with respect to the wearer.

Hahn, et al., U.S. Pat. No. 5,306,267 (1994) discloses a reusable multi-layer diaper which comprises an inner layer that contacts the body of a user and is made from a polyester wicking fabric, a significantly absorbent middle layer made from viscose fibers, and an outer layer that is impermeable to liquids. The inner and outer layers are joined together by an adhesive.

Rose, U.S. Pat. No. 4,884,299 (1989) discloses a disposable bib comprising a main layer of absorbent material, a central layer of moisture-impervious material housed within the main layer, a font layer of gauze-like material that is sealed to be an integral part of the main layer. The bib has a neck cutout which is made from a perforation near the top of the main layer. The neck cutout is positioned so that the neck access slot is over toward the wearer's shoulder rather than behind the wearer's head.

Foti U.S. Pat. No. 4,733,411 (1988) discloses a disposable bib comprising an outer absorbent paper layer and an inner waterproof plastic layer. The layers are bonded together in an overlapping relationship with adhesive and connected along their outer boundaries and neckline with over-lock stitching. The bib is removably attached over the shoulder of the user by securing an adhesive tab over a neck slot. The neck slot is positioned sideways of the hole which forms the neckline.

Kahn, U.S. Pat. No. 4,660,225 (1987) discloses an ornamental bib made of highly light reflective Nylon fabric material upon its outer surface. The bib has a fastening means to secure it about the user's neck. In the preferred embodiment, the reflective material is nylon tricot lame.

Tepper, U.S. Pat. No. 4,620,323 (1986) discloses a disposable bib having a perforated inner border extending along its bottom and the lower parts of its sides to contour the bib so that its lower edges are raised to block drips and spills. The bib is secured about the neck of the wearer using resealable tape.

Savin et al., U.S. Pat. No. 4,475,250 (1984) discloses a disposable bib comprising a flexible sheet material and a pair of tear-away ties formed by a cut line extending through the margin of the flexible sheet material. The inner side of the bib is a waterproof thermoplastic resin and an absorbent layer on the other side. The absorbent layer of material may be constructed of randomly oriented non-woven synthetic or natural fibers.

Dawn et al., U.S. Pat. No. 4,411,660 (1983) discloses a multi-layer, fluid absorbent undergarment. The undergarment is comprised of a water pervious facing layer that makes contact with the skin and a fibrous layer over the water pervious layer which forms an absorbent container therebetween. Inside the absorbent container is an absorbent mass comprising a hydrolyzed starch-acrylonitrile graft copolymer. This copolymer forms a gel upon contact with an aqueous medium.

Gruenwald, U.S. Pat. No. 3,979,776 (1976) discloses a disposable bib comprising an elongated, substantially rectangular sheet having a U-shaped cutout along its upper edge. The sheet is formed from a composite of three layers. The back layer is a thermoplastic film such as, but not limited to, polyethylene. The middle layer is a cellulosic wading for absorption. The third layer is a paper-like material.

Thompson, U.S. Pat. No. 3,916,447 discloses a protective covering having at least one layer of synthetic polymeric micro-fibers bonded to at least one other layer of cellulose fibers without requiring a chemical adhesive. The combination of these layers is a soft, flexible aqueous liquid barrier web that is useful as a dinner napkin, bib or furniture cover.

Mille, U.S. Pat. No. 2,440,666 (1946) discloses a paper bib having a readily adjustable, generally elliptical neck opening. To form the adjustable straps, a neck slit is provided extending directly from a point in the upper part of the neck toward the center of the top edge of the sheet. Adhesive material is affixed to at least one of the straps.

Walbridge, U.S. Pat. No. 889,073 (1908) discloses a bib comprising two plies of material secured at their outer edges and unconnected at the neck portion of the bib to form a pocket within the bib.

None of these previous efforts disclose all of the benefits of the present invention, nor do these previous patents teach or suggest all of the elements of the present invention.

OBJECTS AND SUMMARY OF THE INVENTION

It is a primary object of the present invention to provide a multi-layer disposable bib.

It is also an object of the present invention to provide a multi-layer disposable bib that has exceptional absorbability.

It is another object of the present invention to provide a multi-layer disposable bib that is relatively light weight.

It is another object of the present invention to provide a multi-layer disposable bib that is impermeable to liquids from one side through to the other side.

It is another object of the present invention to provide a multi-layer disposable bib that may be adjustably secured about a person's neck.

It is another object of the present invention to provide a multi-layer disposable bib that is easy to secure about a person's neck.

It is even another object of the present invention to provide a multi-layer disposable bib that is easy to manufacture.

It is yet another object of the present invention to provide a multi-layer disposable bib that can be manufactured without requiring chemical adhesives to attach the separate layers of material together.

It is yet another object of the present invention to provide a multi-layer disposable bib that can be manufactured using ultrasonic bonding.

It is yet another object of the present invention to provide a multi-layer disposable bib having a pin dot pattern formed thereon by ultrasonic bonding.

It is yet another object of the present invention to provide a multi-layer disposable bib having a pin dot pattern formed on the entire surface of the bib.

It is still yet another object of the invention to provide a multi-layer disposable bib which absorbs a significant amount of liquid over its outer surfaces but has an inner surface which prevents those liquids from reaching the other side of the bib.

It is still yet another object of the invention to provide a multi-layer disposable bib that does not deteriorate when wet.

It is still yet another object of the invention to provide a multi-layer disposable bib that does not deteriorate in response to the liquids which may emanate from the baby's mouth.

It is still yet another object of the invention to provide a multi-layer disposable bib that can be washed and reused.

It is still another object of the present invention to provide a multi-layer bib that is aesthetically pleasing as well as functional.

It is still another object of the present invention to provide a multi-layer disposable bib that can be constructed from conventional materials.

It is even another object of the present invention to provide a multi-layer disposable bib that has a structural integrity which is superior to the structural integrity of a conventional disposable bib.

It is even another object of the present invention to provide a multi-layer disposable bib that is soft against the person's skin.

It is even another object of the present invention to provide a multi-layer disposable bib that is fabricated from lint-free material.

It is even another object of the present invention to provide a multi-layer disposable bib which has layers that are resistant to separation.

It is even another object of the present invention to provide a multi-layer disposable bib having interior layers which are highly effective at pulling moisture away from the exterior surface of the bib, thereby reducing chafing and the growth of bacteria and other germs.

It is even another object of the present invention to provide a multi-layer disposable bib having non-woven exterior surfaces.

It is even another object of the present invention to provide a multi-layer disposable bib that feels like cloth to a person's touch.

It is even another object of the present invention to provide a multi-layer disposable bib having a first or upper exterior layer that is comprised of a tear resistant material.

It is even another object of the present invention to provide a multi-layer disposable bib having a second absorbent layer that is highly absorbent.

It is even another object of the present invention to provide a multi-layer disposable bib having a third absorbent layer that is highly absorbent.

It is still even another object of the present invention to provide a disposable bib having a multi-layer highly absorbent material for absorbing spills.

It is still even another object of the present invention to provide a disposable bib having a multi-layer, highly absorbent tissue material.

It is even another object of the present invention to provide a multi-layer disposable bib having an inner liquid impermeable layer of material.

It is even another object of the present invention to provide a multi-layer disposable bib having a lower exterior layer that is comprised of a tear resistant material.

It is even another object of the present invention to provide a composite material which can be used for changing pads and burp pads or any other hygienic use.

It is even another object of the present invention to provide a multi-layer disposable bib having a lower exterior layer that is highly absorbent to prevent back spills from soiling the person's clothing.

It is even another object of the present invention to provide a disposable bib that is comfortable to wear.

It is even another object of the present invention to provide a multi-layer disposable bib invention having an outer layer which is capable of being colored various colors.

These and other objects are achieved by the present invention which comprises a multi-layer disposable bib having the layers ultrasonically bonded together. The ultrasonic bonding forms a pin dot pattern over the entire bib. Together, the layers form a lightweight, tear resistant composite material having highly absorbent front and back layer and a liquid impermeable inner layer. The composite material is cut into a shape which functionally covers the torso of a person, permitting freedom of movement while covering those areas of the torso which typically require protection against food spills. The bib is secured about the person's neck by adjustable straps extending from the upper end of the bib. The straps form the upper portion of the surface area which protects the person.

BRIEF DESCRIPTION OF THE DRAWINGS

Other important objects and features of the invention will be apparent from the following Detailed Description of the Invention when read in context with the accompanying drawings in which.

DETAILED DESCRIPTION OF THE INVENTION

Figure 1:
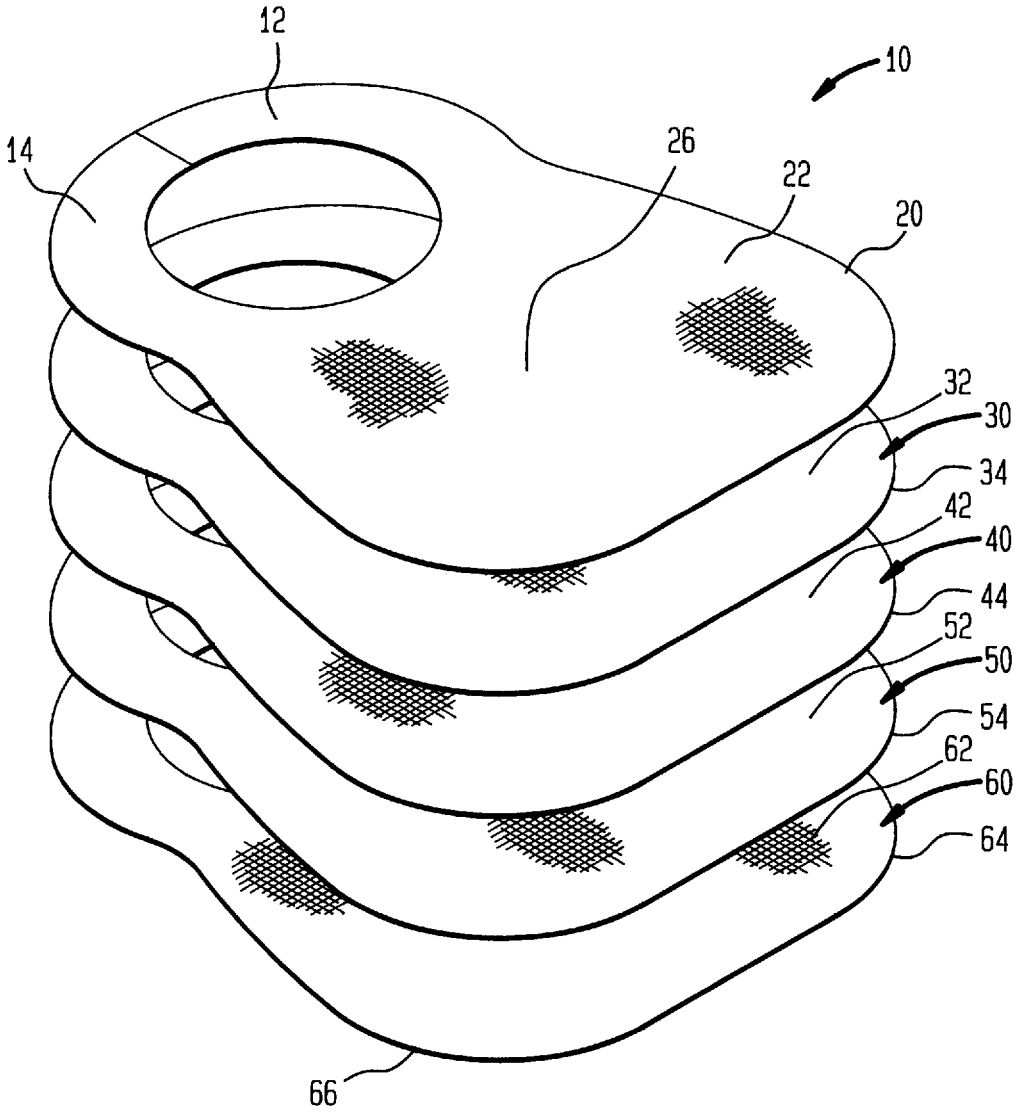
FIG. 1 is an exploded view of the multi-layer disposable bib of the present invention.
Figure 2:
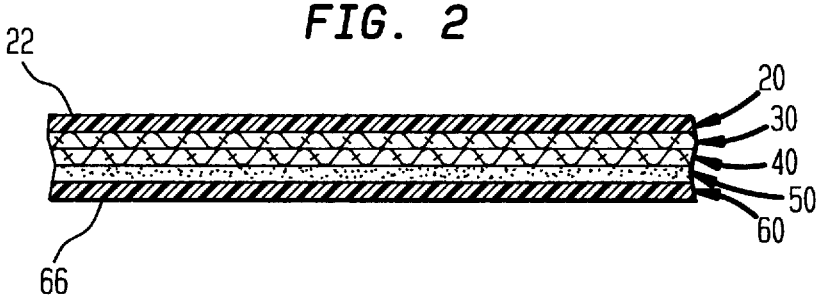
FIG. 2 is a partial, cross-sectional view of the multi-layer disposable bib shown in FIG. 1.

The present invention relates to a multi-layer disposable bib for a baby or person that comprises multiple layers of material ultrasonically bonded together. The bib is a lightweight shield having absorbent exterior layers and a liquid impermeable interior layer. As shown in FIGS. 1 and 2, the disposable baby's bib, generally indicated at 10, comprises a tear resistant upper layer 20, an absorbent layer 30, another absorbent layer 40, a liquid impermeable layer 50 and a tear resistant lower layer 60.

The upper layer 20 preferably comprises a lightweight, non-woven and tear resistant material having an upper surface 22 and a lower surface 24. A preferred material for upper layer 20 is a thermal bond or spun bond polypropylene material having a surface density of 17 to 19 grams per square yard. The upper surface 22 forms the front exterior surface 26 of the disposable bib 10.

The next layer 30 is a highly absorbent thin tissue material having an upper surface 32 and a lower surface 34. The upper surface 32 of the absorbent layer 30 contacts the lower surface 24 of the upper layer 20.

The next layer 40 is also a highly absorbent thin tissue material much like, if not identical to, layer 30. Absorbent layer 40 has an upper surface 42 and a lower surface 44. The upper surface 42 contacts the lower surface 34 of the layer 30. Together, absorbent layers 30 and 40 form an absorbent tissue layer that is highly effective at pulling moisture away from the upper layer 20 into the absorbent layers 30 and 40. It should be noted that the layers 30 and 40 may be a single two-ply tissue layer or other absorbent means.

The next layer 50 is a waterproof or liquid impermeable shield having an upper surface 52 and a lower surface 54. In the preferred embodiment, this barrier layer 50 is a polypropylene film material one half millimeter thick and 10½ to 12½ pounds per ream. Such a polypropylene material prevents liquids absorbed by the tissue layers 30 and 40 from soaking through the bib 10. The upper surface 52 of the barrier layer 50 contacts the lower surface 44 of the third layer 40.

The bottom layer 60 is a soft, lightweight, non-woven and tear resistant material, much like, if not identical to, the upper layer 20. The bottom layer 60 has an upper surface 62 and a lower surface 64. The upper surface 62 of the bottom layer 60 contacts the lower surface 54 of the barrier layer 50. The lower surface 64 of the bottom layer 60 forms the underside or back exterior surface 66 of the disposable bib 10. The soft absorbent bottom layer 60 absorbs spills that go behind the disposable bib 10, and this layer is also soft against a baby or other wearer.

Both the upper layer 20 and the lower layer 60 are made of a tear resistant material which is colorable. In the preferred embodiment of the invention, these upper and lower layers 20 and 60 may be colored pink or blue.

Figure 3:
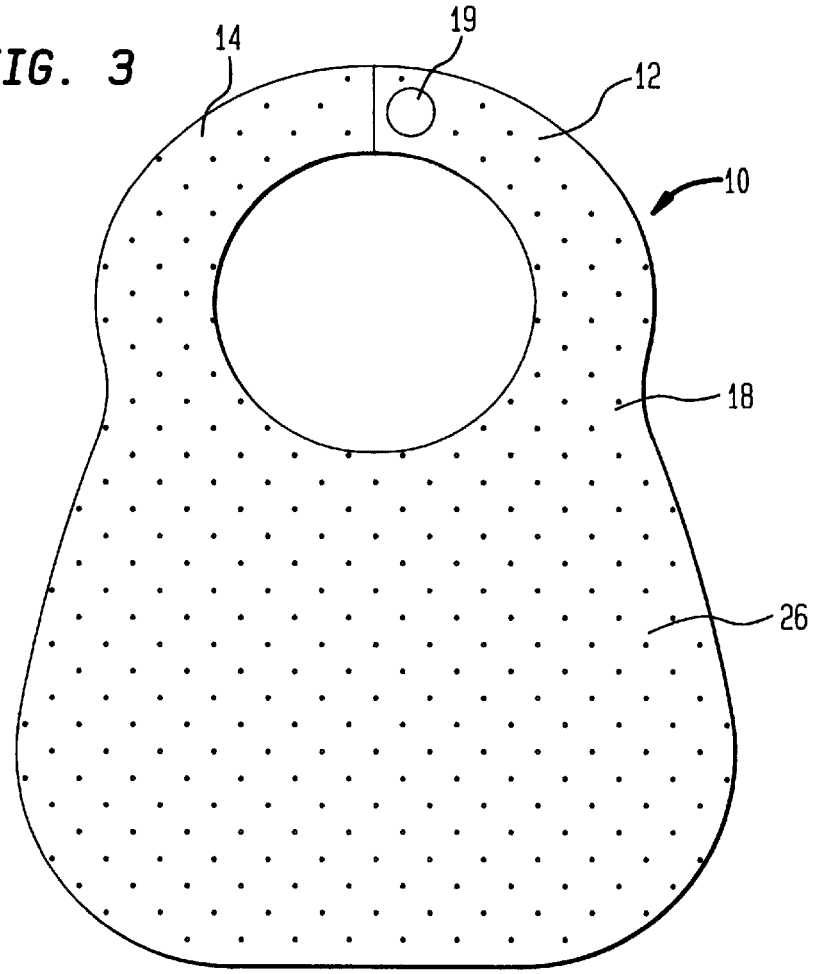
FIG. 3 is a top plan view of the multi-layer disposable bib shown in FIG. 1.
Figure 4:
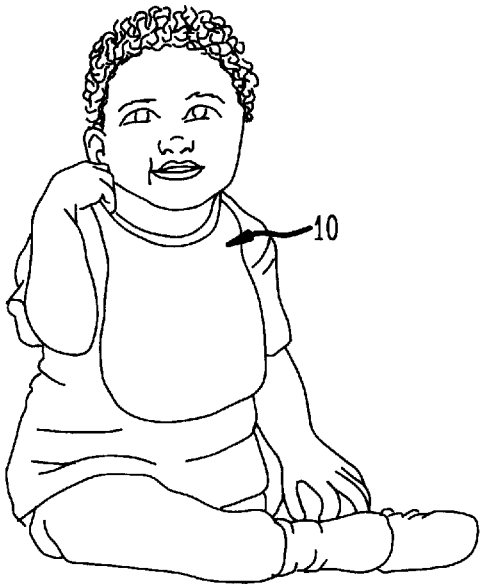
FIG. 4 is a perspective view of the multi-layer disposable bib shown in FIG. 1, positioned about the neck of the baby.

As shown in FIG. 1, each layer 20, 30, 40, 50 and 60 of the disposable bib 10 is cut into a matching shape to generally cover the chest, stomach and neck of a baby. As shown in FIG. 3, the preferred embodiment of the multi-layer disposable bib 10 is guitar-shaped wherein the layers 20, 30, 40, 50 and 60 of material are cut narrowly along the baby's arms and shoulders to provide comfort and freedom of movement, then gradually becomes wider to sufficiently cover the baby's stomach where extra protection is typically required.

Further, each separate layer 20, 30, 40, 50 and 60 is shaped to form a pair of straps 12 and 14 extending from the upper end of the bib 10 for fastening about the baby's neck to attach the bib 10 to a baby. The straps may be adjusted about a baby's neck by means of a double-stick adhesive or refastenable tab 16 located on one of the straps, or by any other adjustable attachment means known in the art.

The bib 10 is attached about a baby's neck by positioning the straps 12 and 14 about a baby's neck and attaching a fastening means 19 between the straps 12 and 14 to join the straps 12 and 14 about a baby's neck.

The close fit about the baby's neck is designed to prevent food spills from traveling underneath the bib and reaching the baby's torso or clothing.

The preferable method of joining together the layers of the disposable bib 10 is though ultrasonic bonding. As shown in FIG. 3, the ultrasonic bonding procedure is applied over the entire surface 26 of the disposable bib 10 to form a pin dot pattern wherein the layers 20, 30, 40, 50 and 60 of separate material are held together in tight contact.

The method of making the disposable bib 10 is as follows: the upper liquid permeable layer 20 is overlaid with the two layers of absorbent tissue-type material 30 and 40, then overlaid with the liquid impermeable layer of material 50 and then overlaid once again with the bottom, second layer of liquid permeable material 60. Once all the layers 20, 30, 40, 50 and 60 are positioned, the layers 20, 30, 40, 50 and 60 are ultrasonically bonded together. Once all the layers 20, 30, 40, 50 and 60 are bonded to each other, the resulting composite is cut into a shape which substantially covers the body of the user and has straps 12 and 14 which can be adjustably secured about the baby's neck. Lastly, a means of adjustably securing the straps of the bib 19 is affixed at the top of the bib's upper surface 26.

Ultrasonically bonding the layers of the disposable bib 10 together is a significant improvement in the manufacture of bibs in that no glues, toxic materials or chemical adhesives are required to fabricate the bib 10.

Further, the use of ultrasonic bonding to attach the layers 20, 30, 40, 50 and 60 of the disposable bib 10 provides small pin dots 18 along the upper surface 22 of the upper layer 20 and also along the lower surface 64 of the bottom layer 60. Each pin dot 18 incrementally increases the surface area that is available to absorb moisture and spilled liquids.

Moreover, the resulting composite material of the disposable bib 10 provides a lint-free surface near the baby's mouth, does not deteriorate in response to liquids which may emanate from a baby's mouth, has layers which are resistant to separation even when wet, can be washed and reused, and by virtue of its overall hygienic qualities, provides a material that is suitable for changing pads or burp pads. In short, the ultrasonic bonding attachment means not only obviates the need for chemical adhesives, it also increases the absorbability of the disposable bib 10 without requiring an increase in the surface area or the thickness of the fabrics and tissues used to make the disposable bib 10.

Having thus described the invention in detail, it is to be understood that the forgoing description is not intended to limit the spirit and scope thereof What is desired to be protected by the Letters Patent is set forth in the appended claims.

What is claimed is:

1. A multi-layer disposable bib comprising:

a first layer of absorbent material, having upper and lower surfaces, the upper surface of which forms the front exterior of the bib;

a second layer of absorbent material, having upper and lower surfaces, the upper surface of which is positioned adjacent to the lower surface of the first layer of absorbent material;

a third layer of absorbent material, having upper and lower surfaces, the upper surface of which is positioned adjacent to the lower surface of the second layer of absorbent material;

a liquid impermeable fourth layer, having upper and lower surfaces, the upper surface of which is positioned adjacent to the lower surface of the third layer of absorbent material;

a fifth layer of absorbent material, having upper and lower surfaces, the upper surface of which is positioned adjacent to the lower surface of the fourth layer of liquid impermeable material, and the lower surface of which forms the back exterior of the bib;

ultrasonic bonds attaching layers together to form a bib;

a neck portion having a circular aperture defined by straps extending from a narrow central portion of the bib, the straps meeting at a top portion of the bib;

the body portion including a wide bottom area tapering to the narrow central portion of the bib; and means associated with the straps for adjustably securing the bib about the neck of the user.

2. The multi-layer disposable bib of claim 1, wherein the second and third layers comprise absorbent tissue paper.

3. The multi-layer disposable bib of claim 2, further comprising a pin-dot pattern formed by ultrasonic bonding of the layers.

4. The multi-layer disposable bib of claim 1, wherein the liquid impermeable layer is a polypropylene film material.

5. The multi-layer disposable bib of claim 1, wherein the first and bottom layers are soft and tear resistant material.

6. The multi-layer disposable bib of claim 1, wherein each layer of material is cut into a shape which covers a person's neck, chest and stomach while providing freedom of movement.

7. The multi-layer disposable bib of claim 1, further including straps extending from the bib for attaching the bib about a person's neck.

8. The multi-layer disposable bib of claim 1, further comprising adjustable attachment means for adjustably securing the straps about a person's neck.

9. A multi-layer disposable bib comprising:

a first layer of non-woven material having upper and lower surfaces;

a second layer of tissue material, having upper and lower surfaces, the upper surface of which is overlapped by the lower surface of the first layer;

a third layer of tissue material, having upper and lower surfaces, the upper surface of which is overlapped by the lower surface of the second layer;

a liquid impermeable fourth layer, having upper and lower surfaces, the upper surface of which is overlapped by the lower surface of the third layer;

a fifth layer of lightweight and tear resistant non-woven material, having upper and lower surfaces, the upper surface of which is overlapped by the lower surface of the fourth layer;

a set of ultrasonic bonds between the layers bond the layers together to form a bib;

a neck portion having a circular aperture defined by straps extending from a narrow central portion of the bib, the straps meeting at a top portion of the bib;

the body portion including a wide bottom area tapering to the narrow central portion of the bib; and means for adjustably securing the straps together about the neck of a user.

10. The multi-layer disposable bib of claim 9, wherein the second and third layers comprise absorbent tissue paper.

11. The multi-layer disposable bib of claim 9, wherein the set of ultrasonic bonds forms a pin-dot pattern over the front and back exterior surfaces of the bib.

12. The multi-layer disposable bib of claim 9, wherein the liquid impermeable layer is a thermalbond polypropylene material.

13. The multi-layer disposable bib of claim 9, wherein the front and back exterior layers are soft and smooth material.

14. The multi-layer disposable bib of claim 9, wherein the front and back exterior layers are tear resistant material.

15. The multi-layer disposable bib of claim 9, wherein each layer of material is cut into a shape which covers a person's neck, chest and stomach while providing freedom of movement.

16. The multi-layer disposable bib of claim 9, further including straps extending from the bib for attaching the bib about a person's neck.

17. The multi-layer disposable bib of claim 9, further comprising adjustable attachment means for adjustably securing the straps about a person's neck.

18. A method of constructing a multi-layer disposable bib comprising the steps of:

providing a liquid permeable material to form the upper exterior layer;

overlaying an absorbent material to form an interior layer;

overlaying another absorbent material to additionally form an interior layer;

overlaying a liquid impermeable material to form an interior barrier layer;

overlaying another liquid permeable material to form a lower exterior layer;

ultrasonically bonding the layers together to form a multi-layer composite;

cutting the multi-layer composite forming a neck portion having a circular aperture defined by straps extending from a narrow central portion of the bib, the straps meeting at a top portion of the bib;

cutting a multi-layer composite forming a body portion including a wide bottom area tapering to a narrow central portion of the bib; and affixing a means of adjustably securing the straps of the bib about a user.

19. The method of claim 18 wherein the step of cutting the material may be performed prior to the ultrasonic bonding.

* * * * *